United States Patent [19]

Maeda et al.

[11] 4,068,463

[45] Jan. 17, 1978

[54] REFERENCE SIGNAL FREQUENCY CORRECTION IN AN ELECTRONIC TIMEPIECE

[75] Inventors: Hidetoshi Maeda, Tenri; Takehiko Sasaki, Yamatokoriyama, both of Japan

[73] Assignee: Sharp Kabushiki Kaisha, Osaka, Japan

[21] Appl. No.: 641,822

[22] Filed: Dec. 17, 1975

[30] Foreign Application Priority Data

Dec. 17, 1974 Japan ..... 49-145232
June 23, 1975 Japan ..... 50-77735

[51] Int. Cl.[2] ..... G04C 23/00; H03K 21/32; H03B 3/04

[52] U.S. Cl. ..... 58/23 AC; 328/48; 331/177 R

[58] Field of Search ..... 58/23 AC, 24–26, 58/50 R, 85.5; 328/48; 331/177

[56] References Cited

U.S. PATENT DOCUMENTS

| | | | |
|---|---|---|---|
| 3,530,663 | 9/1970 | Marti | 58/23 R |
| 3,540,207 | 11/1970 | Keeler | 58/23 R |
| 3,672,155 | 6/1972 | Bergey et al. | 58/50 R |

*Primary Examiner*—E. S. Jackmon

*Attorney, Agent, or Firm*—Birch, Stewart, Kolasch & Birch

[57] ABSTRACT

Zero adjustment of second information in an electronic timepiece is carried out upon receiving a command from the operator through a zero adjust switch. Increment one is performed on minute information when the second information is above a predetermined value, for example, twenty-four seconds when the zero adjustment command is generated. The reference signal frequency is automatically corrected by detecting the second information when the zero adjustment command is generated, in such a manner that the reference signal frequency is increased to render the timepiece faster when the second information is above the predetermined value, and the reference signal frequency is decreased to render the timepiece slower when the second information is below the predetermined value when the zero adjustment command is generated. A duration counter is preferably provided for detecting a time period initiating upon generation of a zero adjustment command and terminating upon generation of the following zero adjustment command. The correction of the reference signal frequency is not carried out when the duration detected by said counter is greater than a predetermined value, for example, one month in order to inhibit the frequency correction when it is not desirable.

8 Claims, 7 Drawing Figures

FIG. 2 (CORRECTION VALUE DETERMINATION CIRCUITS -14 AND 15-)
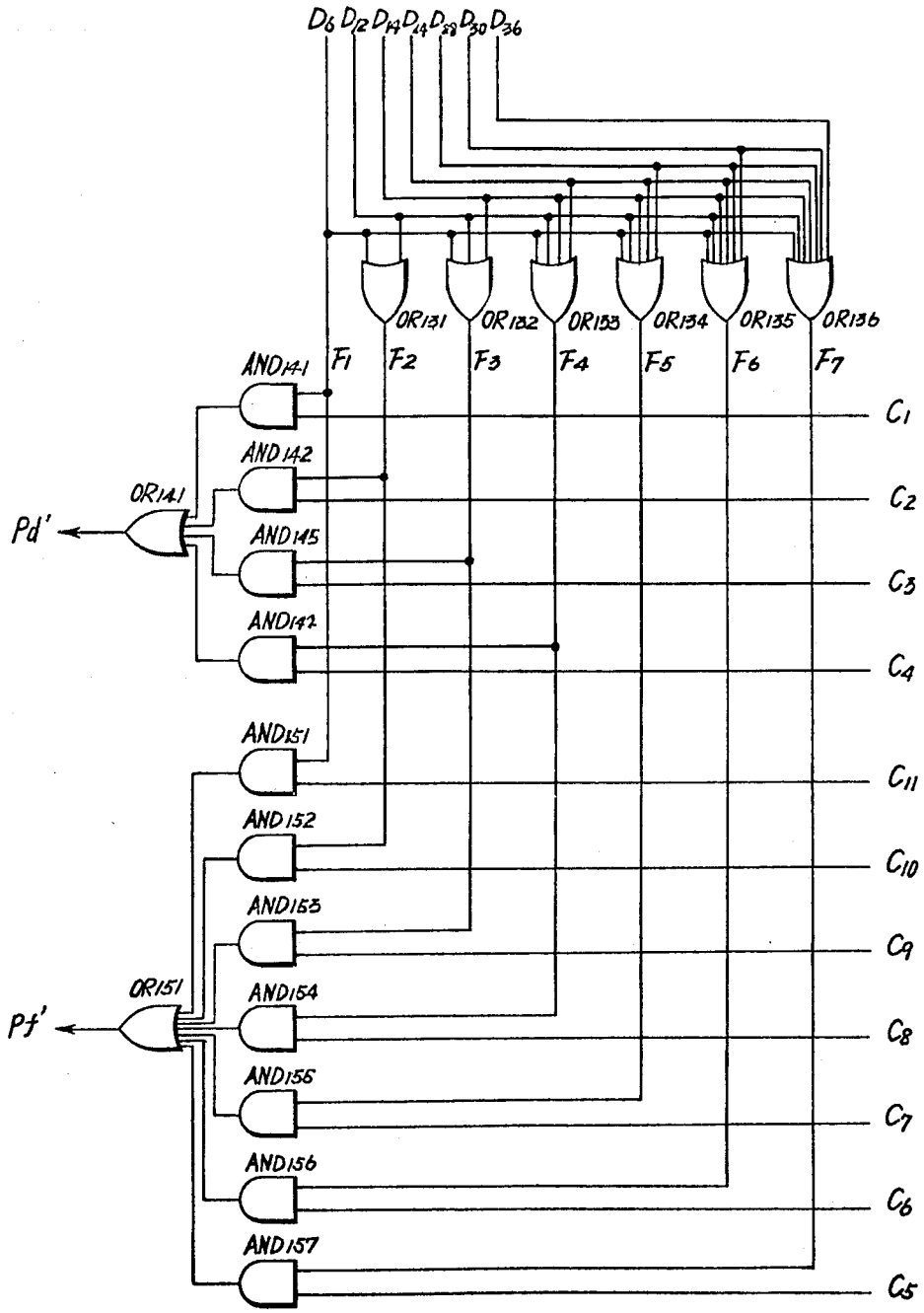

FIG. 3 ( LOSE CORRECTION SIGNAL GENERATOR -16- )
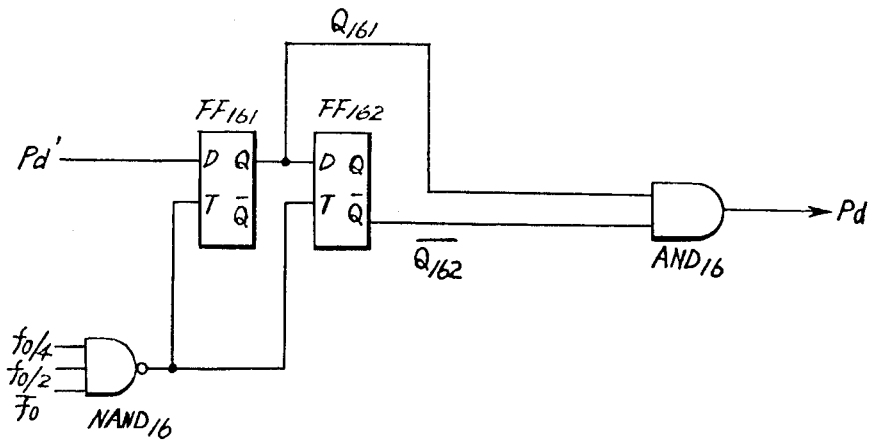
FIG. 4 ( GAIN CORRECTION SIGNAL GENERATOR -17- )
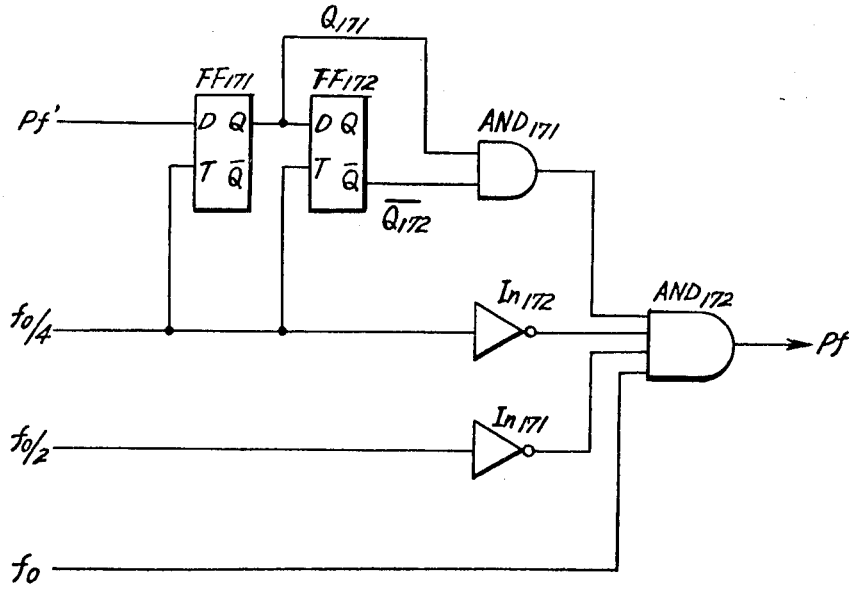

REFERENCE SIGNAL FREQUENCY CORRECTION IN AN ELECTRONIC TIMEPIECE

BACKGROUND OF THE INVENTION

The present invention relates to an electronic timepiece and, more particularly, to an automatic correction system of a reference signal frequency in an electronic timepiece.

In general a quartz oscillator is employed in an electronic timepiece for developing a reference signal of a predetermined frequency, for example, one hertz via an appropriate frequency divider. The oscillation frequency of the quartz oscillator is usually adjusted through the use of a variable capacitor called a trimmer. However, the natural frequency of the quartz oscillator will undergo modification with the lapse of time in an irreversible manner on account of the phenomenon of "ageing" and on account of the environment, for example, the ambient temperature and any shocks to which the oscillator is subject.

Heretofore, it has been proposed, to eliminate the above deficiencies, to provide an oscillation frequency stabilizing circuit or a temperature compensation circuit in an oscillation circuit for driving the quartz oscillator. However, these circuits operate in an analogue fashion and require large spaces in an electronic timepiece. Therefore, these circuits can not be employed in, especially, an electronic wristwatch.

Recently, a zero adjustment system has been developed in which the zero adjustment of second information in an electronic timepiece is carried out upon receiving a command from the operator through a zero adjust switch. In such a system, the time information is nearly corrected to show accurate time information when the zero adjust operation is commanded in response to a time tone. But the tendency in gaining or losing of the electronic timepiece can not be compensated.

OBJECTS AND SUMMARY OF THE INVENTION

Accordingly, an object of the present invention is to provide a correction system for automatically compensating the tendency of gaining or losing in the electronic timepiece.

Another object of the present invention is to provide a reference signal frequency correction circuit for use in an electronic timepiece.

Still another object of the present invention is to provide an automatic reference signal frequency correction circuit for modifying the reference signal frequency in response to a zero adjustment operation.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objectives, pursuant to an embodiment of the present invention, a detection circuit is provided to detect the second information when the zero adjustment command is generated, thereby detecting whether the electronic timepiece has gained or has lost. When the electronic timepiece has gained, the reference signal frequency is decreased in a digital fashion to render the electronic timepiece slower. When the electronic timepiece has lost, the reference signal frequency is increased in a digital fashion to render the electronic timepiece faster.

However, there is a possibility that the detection circuit erroneously detects that the electronic timepiece gains when the timepiece has lost to a large degree. Also, there is a possibility that the detection circuit erroneously detects that the electronic timepiece loses when the timepiece has gained to a high degree.

To avoid an frequency correction due to the erroneous detection of the detection circuit, a duration counter is provided for detecting a time period initiating upon generation of a zero adjustment command and terminating upon generation of the following zero adjustment command. The correction of the reference signal frequency is not carried out when the duration detected by said counter is greater than a predetermined value, for example, one month, thereby inhibiting the frequency correction when it is not desirable.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

FIG. 2 is a block diagram of an embodiment of the correction value determination circuits illustrated in FIG. 1;

FIG. 3 is a block diagram of an embodiment of the lose correction signal generator illustrated in FIG. 1;

FIG. 4 is a block diagram of an embodiment of the gain correction signal generator illustrated in FIG. 1;

DESCRIPTION OF THE PREFERRED EMBODIMENTS

Figure 1:
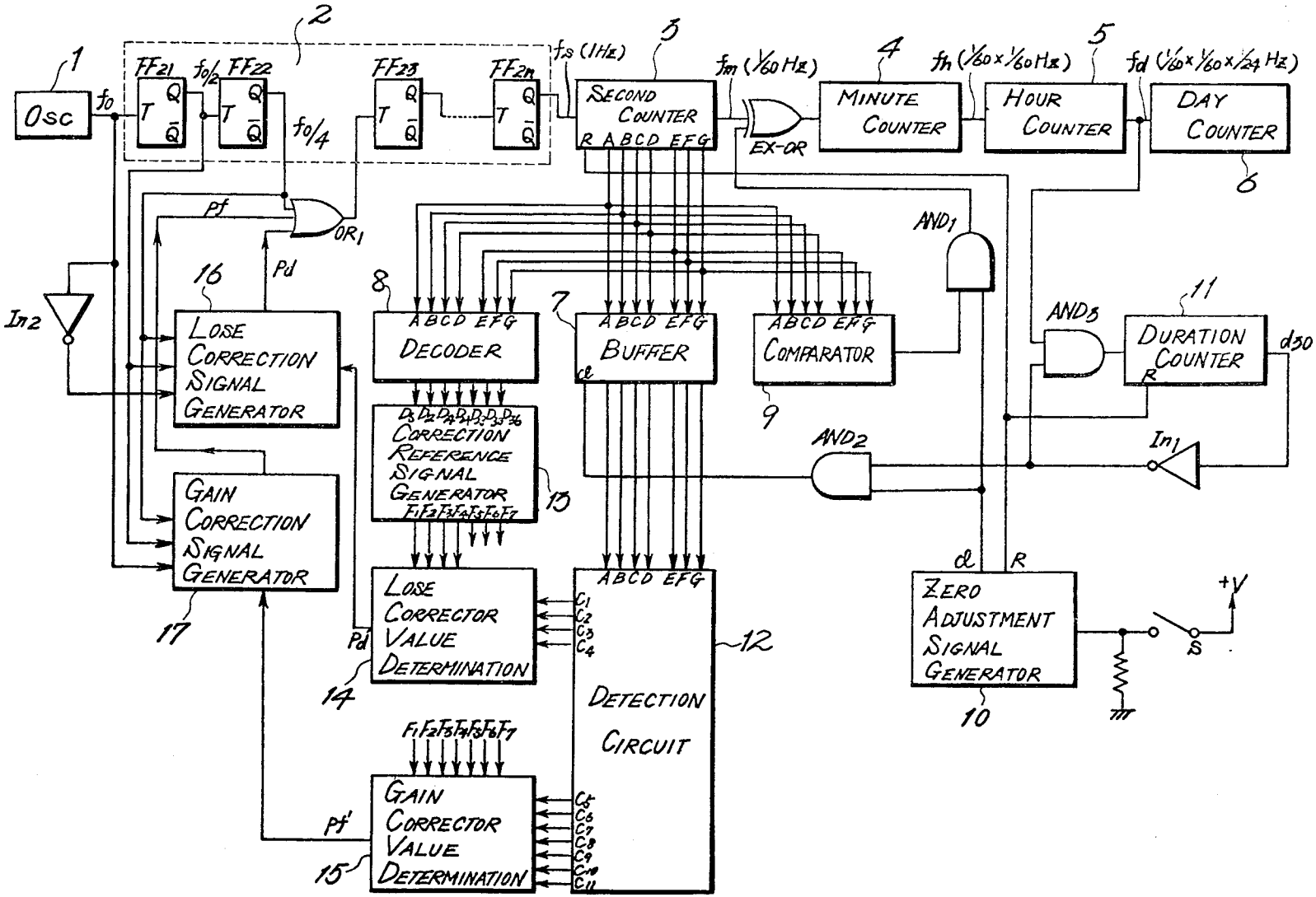
FIG. 1 is a block diagram of an electronic timepiece including a lose correction signal generator, a gain correction signal generator and correction value determination circuits of the present invention.

Referring now to FIG. 1, there is illustrated an embodiment of the present invention, in which an oscillation circuit 1 including a quartz oscillator therein generates a base signal $f_o$ of 32.768 kilohertz.

A frequency divider 2 comprises a chain of T-type flip-flops $FF_{21}$-$FF_{2n}$ and develops a reference signal $f_s$ of one hertz. An OR gate $OR_1$ is disposed between the second flip-flop $FF_{22}$ and the third flip-flop $FF_{23}$, whereby the T terminal of the third flip-flop $FF_{23}$ is connected to receive not only an output signal $f_o/4$ of the second flip-flop $FF_{22}$ but also a lose correction signal Pd and a gain correction signal Pf, which will be described later. The reference signal $f_s$ of one hertz is sequentially introduced into a second counter 3, a minute counter 4, an hour counter 5 and a day counter 6. The time information stored in the respective counters is displayed on a preferred display unit via suitable decoder/driver circuits. The display unit and the decoder/driver circuits can be of any constructions known in the art and since the specific details thereof do not constitute a part of the present invention they have been omitted for the purposes of simplicity.

The second counter 3 comprises a seconds counter and ten seconds counter. The seconds counter is a decimal counter whereas the ten seconds counter is hexal counter, whereby the second counter 3 acts as a counter of radix sixty.

Binary-coded decimal (BCD) outputs of the seconds counter and the ten seconds counter included within the second counter 3 can be tabulated as follows:

TABLE OF BCD OUTPUT OF THE SECONDS COUNTER

| BCD OUTPUT / DECIMAL NUMBER | A (1) | B (2) | C (4) | D (8) |
|---|---|---|---|---|
| 0 | 0 | 0 | 0 | 0 |
| 1 | 1 | 0 | 0 | 0 |
| 2 | 0 | 1 | 0 | 0 |
| 3 | 1 | 1 | 0 | 0 |
| 4 | 0 | 0 | 1 | 0 |
| 5 | 1 | 0 | 1 | 0 |
| 6 | 0 | 1 | 1 | 0 |
| 7 | 1 | 1 | 1 | 0 |
| 8 | 0 | 0 | 0 | 1 |
| 9 | 1 | 0 | 0 | 1 |

TABLE OF BCD OUTPUT OF THE TEN SECONDS COUNTER

| BCD OUTPUT / DECIMAL NUMBER | E (1) | F (2) | G (4) |
|---|---|---|---|
| 0 | 0 | 0 | 0 |
| 1 | 1 | 0 | 0 |
| 2 | 0 | 1 | 0 |
| 3 | 1 | 1 | 0 |
| 4 | 0 | 0 | 1 |
| 5 | 1 | 0 | 1 |

The BCD outputs of the second counter 3 are applied to a buffer memory 7, a correction reference signal generation decoder 8, a comparator 9 and a second information display decoder, not shown, respectively.

The buffer memory 7 comprises D-type flip-flops the number of which corresponds to the number of output terminals of the second counter 3, namely, the number of BCD outputs, for instance, seven. The buffer memory 7 reads in and stores the BCD outputs derived from the second counter 3 in response to the leading edge of a clock signal cl applied to a cl terminal thereof. The comparator 9 introduces the BCD outputs of the second counter 3 into it in order to detect whether the second information is above 24. When the second information is greater than 24, the comparator 9 develops an output signal on the logic value "1", whereby a carry signal is applied to the minute counter 4 via an AND gate $AND_1$ and an exclusive OR gate EX-OR. The other terminal of the exclusive OR gate EX-OR receives a minute signal $f_m$ of 1/60 hertz from the second counter 3.

A switch S is installed on the casing of the electronic timepiece to generate a zero adjustment command. When the operator depresses the switch S, a voltage V is applied to a zero adjustment signal generator 10, which develops the clock signal cl and a reset signal R of a predetermined pulse width upon depression of the switch S. The clock signal cl is applied to the cl terminal of the buffer memory 7 through an AND gate $AND_2$, and is also applied to the other input terminal of the AND gate $AND_1$, thereby controlling the output of the comparator 9. The reset signal R has the leading edge thereof after the provision of the trailing edge of the clock signal cl. The reset signal R is applied to reset terminals R of the second counter 3 and a duration counter 11 in order to reset the information, or clear the information stored in the second counter 3 and the duration counter 11.

The duration counter 11 receives a day signal $f_3$ of $1/60 \times 1/60 \times 1/24$ hertz from the hour counter 5 via an AND gate $AND_3$. When the duration counter 11 receives thirty pulses of the day signal $f_d$, an output $d_{30}$ of the duration counter 11 bears the logic value "1".

The output $d_{30}$ of the duration counter 11 is applied to the other input terminal of the AND gate $AND_3$ via an inverter $In_1$. The AND gate $AND_3$ is maintained at its non-conductive condition when the duration counter 11 counts thirty days and, therefore, the output $d_{30}$ of the duration counter 11 bears the logical value "0" during a time period within thirty days from the biginning of the counting operation of the duration counter 11 and bears the logical "1" after the lapse of thirty days from the biginning of the counting operation of the duration counter 11.

The output $d_{30}$ of the counter 11 is applied to the AND gate $AND_2$ via the inverter $In_1$, thereby controlling the application of the clock signal cl to the cl terminal of the buffer memory 7.

Output signals of the buffer memory 7 are applied to a detection circuit 12. The detection circuit 12 functions to develop second detection signals $C_1$ through $C_{11}$ in accordance with the second information stored in the buffer memory 7. The second information is divided into eleven groups, each group consisting of 4–8 seconds, 9–13 seconds, 14–18 seconds, 19–23 seconds, 24–26 seconds, 27–31 seconds, 32–36 seconds, 37–41 seconds, 42–46 seconds, 47–51 seconds and 52–56 seconds. The detection circuit 12 determines in which group the time information derived from the buffer memory 7 in the BCD notation belongs in accordance with the following table.

TABLE OF DETECTION LOGIC OF THE DETECTION CIRCUIT - 12 -

| SECOND INFORMATION | DETECTION LOGIC |
|---|---|
| 4 ~ 3 | $C_1 = (\overline{A} \cdot D + C) \cdot \overline{E} \cdot \overline{F} \cdot \overline{G}$ |
| 9 ~ 13 | $C_2 = (A \cdot D) \cdot \overline{E} \cdot \overline{F} \cdot \overline{G} + (\overline{C} \cdot \overline{D}) \cdot E \cdot \overline{F} \cdot \overline{G}$ |
| 14 ~ 18 | $C_3 = (\overline{A} \cdot D + C) \cdot E \cdot \overline{F} \cdot \overline{G}$ |
| 19 ~ 23 | $C_4 = (A \cdot D) \cdot \overline{E} \cdot \overline{F} \cdot \overline{G} + (\overline{C} \cdot \overline{D}) \cdot \overline{E} \cdot F \cdot \overline{G}$ |
| 24 ~ 26 | $C_5 = (\overline{A} \cdot C + \overline{B} \cdot C) \overline{E} \cdot F \cdot \overline{G}$ |
| 27 ~ 31 | $C_6 = (D + A \cdot B \cdot C) \cdot \overline{E} \cdot F \cdot \overline{G} + (\overline{B} \cdot \overline{C} \cdot \overline{D}) \cdot E \cdot F \cdot \overline{G}$ |
| 32 ~ 36 | $C_7 = (B \cdot \overline{C} + \overline{A} \cdot C + \overline{B} \cdot C) \cdot E \cdot \overline{F} \cdot \overline{G}$ |
| 37 ~ 41 | $C_8 = (D + A \cdot B \cdot C) \cdot E \cdot F \cdot \overline{G} + (\overline{B} \cdot \overline{C} \cdot \overline{D}) \cdot \overline{E} \cdot \overline{F} \cdot G$ |
| 42 ~ 46 | $C_9 = (B \cdot \overline{C} + \overline{A} \cdot C + \overline{B} \cdot C) \cdot \overline{E} \cdot \overline{F} \cdot G$ |
| 47 ~ 51 | $C_{10} = (D + A \cdot B \cdot C) \cdot \overline{E} \cdot \overline{F} \cdot G + (\overline{B} \cdot \overline{C} \cdot \overline{D}) \cdot E \cdot \overline{F} \cdot G$ |
| 52 ~ 56 | $C_{11} = (B \cdot \overline{C} + \overline{A} \cdot C + \overline{B} \cdot C) \cdot E \cdot \overline{F} \cdot G$ |

The correction reference signal generator decoder 8 receives the BCD outputs of the second counter 3 and develops signals $D_6$, $D_{12}$, $D_{14}$, $D_{24}$, $D_{28}$, $D_{30}$ and $D_{36}$ which bear the logic value "1" when the second information in the second counter 3 is "6", "12", "14", "24", "28", "30" and "36", respectively.

FIG. 2 shows a typical circuit construction of a correction reference signal generator 13, a lose correction value (for rendering the timepiece slow) determination circuit 14 and a gain correction (for rendering the timepiece fast) determination circuit 15.

The correction reference signal generator 13 receives the signals $D_6$, $D_{12}$, $D_{14}$, $D_{24}$, $D_{28}$, $D_{30}$ and $D_{36}$ from the correction reference signal genration decoder 8 and develops signals $F_1$, $F_2$, $F_3$, $F_4$, $F_5$, $F_6$ and $F_7$ which are the logic sums of $D_6$, $D_6 + D_{12}$, $D_6 + D_{12} + D_{14}$, $D_6 + D_{12} + D_{14} + D_{24}$, $D_6 + D_{12} + D_{14} + D_{24} + D_{28}$, $D_6 + D_{12} + D_{14} + D_{24} + D_{28} + D_{30}$, and $D_6 + D_{12} + D_{14} + D_{24} + D_{28} + D_{30} + D_{36}$, respectively, through the use of OR gates $OR_{131}$, $OR_{132}$, $OR_{133}$, $OR_{134}$, $OR_{135}$ and $OR_{136}$.

The lose correction value determination circuit 14 receives the signals $F_1$, $F_2$, $F_3$ and $F_4$ from the correction reference signal generator 13, and the second detection signals $C_1$ through $C_4$ from the detection circuit 12. The lose correction value determination circuit 14 comprises AND gates $AND_{141}$, $AND_{142}$, $AND_{143}$ and $AND_{144}$ and an OR gate $OR_{141}$. The AND gate $AND_{141}$ receives the signals $F_1$ and $C_1$, the AND gate $AND_{142}$ receives the signals $F_2$ and $C_2$, the AND gate $AND_{143}$ receives the signals $F_3$ and $C_3$, and the AND gate $AND_{144}$ receives the signals $F_4$ and $C_4$. Output signals of the AND gates $AND_{141}$ through $AND_{144}$ are applied to the OR gate $OR_{141}$, thereby providing an output signal $P_d'$. When the second detection signal $C_1$ assumes the logic value "1", the output signal $P_d'$ of the lose correction value determination circuit 14 is a signal having a frequency of 1/60 hertz. When the second detection signal $C_2$ takes the logic value "1", the output signal $P_d'$ is a signal having a frequency of 2/60 hertz. When the second detection signal $C_3$ has the logic value "1", the output signal $P_d'$ has a frequency of 3/60 hertz. When the second detection signal $C_4$ has the logic value "1", the output signal $P_d'$ has a frequency of 4/60 hertz.

The gain correction value determination circuit 15 receives the signals $F_1$, $F_2$, $F_3$, $F_4$, $F_5$, $F_6$ and $F_7$ from the correction reference signal generator 13, and the second detection signals $C_5$ through $C_{11}$ from the detection circuit 12. The gain correction value determination circuit 15 comprises AND gates $AND_{151}$ through $AND_{157}$ and an OR gate $OR_{151}$. The AND gate $AND_{151}$ receives the signals $F_1$ and $C_{11}$, the AND gate $AND_{152}$ receives the signals $F_2$ and $C_{10}$, and the AND gate $AND_{153}$ receives the signals $F_3$ and $C_9$. The AND gates $AND_{154}$, $AND_{155}$, $AND_{156}$ and $AND_{157}$ receive the signals $F_4$ and $C_8$, $F_5$ and $C_7$, $F_6$ and $C_6$, and $F_7$ and $C_5$, respectively. Output signals of the AND gates $AND_{151}$ through $AND_{157}$ are applied to the OR gate $OR_{151}$, thereby providing an output signal $P_f'$.

When the detection signals $C_5$ through $C_{11}$ bear the logic value "1", the output signal $P_f'$ of the gain correction value determination circuit 15 has frequencies of 7/60 hertz, 6/60 hertz, 5/60 hertz, 4/60 hertz, 3/60 hertz, 2/60 hertz and 1/60 hertz, respectively.

The output signals $P_d$ and $P_f'$ of the lose correction value determination circuit 14 and the gain correction value determination circuit 15 are applied to a lose correction signal (which renders the timepiece slower) generator 16 and a gain correction signal (which renders the timepiece faster) generator 17, respectively. The lose correction signal generator 16 develops a lose correction signal $P_d$ (which renders the timepiece slower), whereas the gain correction signal generator 17 develops a gain correction signal $P_f$(which renders the timepiece faster).

FIG. 3 shows a typical circuit construction of the lose correction signal generator 16, whereas FIG. 4 shows a typical circuit construction of the gain correction signal generator 17.

The output signal $P_d'$ of the lose correction value determination circuit 14 is applied to the D terminal of a D-type flip-flop $FF_{161}$. The Q terminal output of the D-type flip-flop $FF_{161}$ is applied to the D terminal of a following D-type flip-flop $FF_{162}$. The T terminals of the D-type flip-flops $FF_{161}$ and $FF_{162}$ are connected to the output terminal of an NAND gate $NAND_{16}$ which receives an inverted signal $\overline{f_o}$ of the base signal $f_o$ generated from the oscillation circuit 1 and the output signals $f_o/2$ and $f_o/4$ of the first and second T-type flip-flops $FF_{21}$ and $FF_{22}$ included within the frequency divider 2. An AND gate $AND_{16}$ receives the Q terminal output of the D-type flip-flop $FF_{161}$ and the $\overline{Q}$ terminal output of the D-type flip-flop $FF_{162}$, thereby providing the OR gate $OR_1$ disposed between the second and third T-type flip-flops $FF_{22}$ and $FF_{23}$ in the frequency divider 2 with the lose correction signal $P_d$.

The output signal $P_f'$ of the gain correction value determination circuit 15 is applied to the D terminal of a D-type flip-flop $FF_{171}$ of which the Q terminal output is applied to the D terminal of a following D-type flip-flop $FF_{172}$. The T terminals of the D-type flip-flops $FF_{171}$ and $FF_{172}$ receive the output signal $f_o/4$ of the second T-type flip-flop $FF_{22}$ of the frequency divider 2. An AND gate $AND_{171}$ is connected to receive the Q terminal output and the Q terminal output of the D-type flip-flops $FF_{171}$ and $FF_{172}$, respectively. An AND gate $AND_{172}$ receives the output of the AND gate $AND_{171}$, an inverted signal $\overline{f_o/2}$ of the output signal $f_o/2$ through an inverter $In_{171}$, an inverted signal $\overline{f_o/4}$ of the output signal $f_o/4$ through an inverter $In_{172}$, and the base signal $f_o$ generated from the oscillation circuit 1, thereby providing the OR gate $OR_1$ with the gain correction signal $P_f$.

The operation mode of the electronic timepiece of the present invention will be appreciated by the following description.

When the zero adjust switch S is depressed in response to a time tone, the zero adjustment signal generator 10 generates the clock signal cl and the reset signal R.

At this time, when the second information stored in the second counter 3 is greater than 24, the comparator 9 develops the signal of the logic value "1". The clock signal cl functions to provide the minute counter 4 with the carry signal through the AND gate $AND_1$ and the exclusive OR gate EX - OR when the output signal of the comparator 9 takes the logic value "1". Contrarily, when the second information stored in the second counter 3 is less than 24, the carry signal will not be developed because the outer signal of the comparator 9 takes the logical value "0".

The system determines that the electronic timepiece is fast when the second information stored in the second counter 3 is less than 24 when the switch S is depressed in response to the time tone and, therefore, the stored information in the second counter 3 is reset to zero. The system determines that the electronic timepiece is slow when the second information stored in the second counter 3 is greater than 24 when the switch S is depressed in response to the time tone and, therefore, the second counter 3 is reset to zero and at the same time the minute information in the minute counter 4 is incremented by one.

When the zero adjustment command is generated within thirty days from the last zero adjustment operation, the clock signal cl is also applied to the cl terminal of the buffer memory 7 through the AND gate $AND_2$ because the output $d_{30}$ of the duration counter 11 takes the logic value "0" and hence the AND gate $AND_2$ receives the signal of the logic value "1" via the inverter $In_1$. When the zero adjustment command is generated after a lapse of thirty days from the last zero adjustment operation, the clock signal cl will not be applied to the cl terminal of the buffer memory 7 since the output $d_{30}$ of the duration counter 11 takes the logic value "1".

Therefore, only when the output $d_{30}$ of the duration counter 11 assumes the logic value "0" and the clock signal cl is applied to the buffer memory 7, the buffer memory 7 reads in the BCD output of the second counter 3 and stores the information in response to the leading edge of the clock signal cl.

The reset signal R takes the logic value "1" after the clock signal cl becomes the logic value "0", thereby resetting the second counter 3 and the duration counter 11. After the reset signal R becomes the logic value "0", the second counter 3 and the duration counter 11 begin their counting operation upon receiving the second signal $f_s$ and the day signal $f_d$, respectively.

The information stored in the buffer memory 7 is detected by the detection circuit 12, thereby developing the second detection signals $C_1$ through $C_{11}$ in accordance with the time information stored in the buffer memory 7. When, for example, the second information is within a range between 4 and 8, the second detection signal $C_1$ assumes the logic value "1". Therefore, the lose correction value determination circuit 14 provides the lose correction signal generator 16 with the signal $F_1$.

Figure 5:
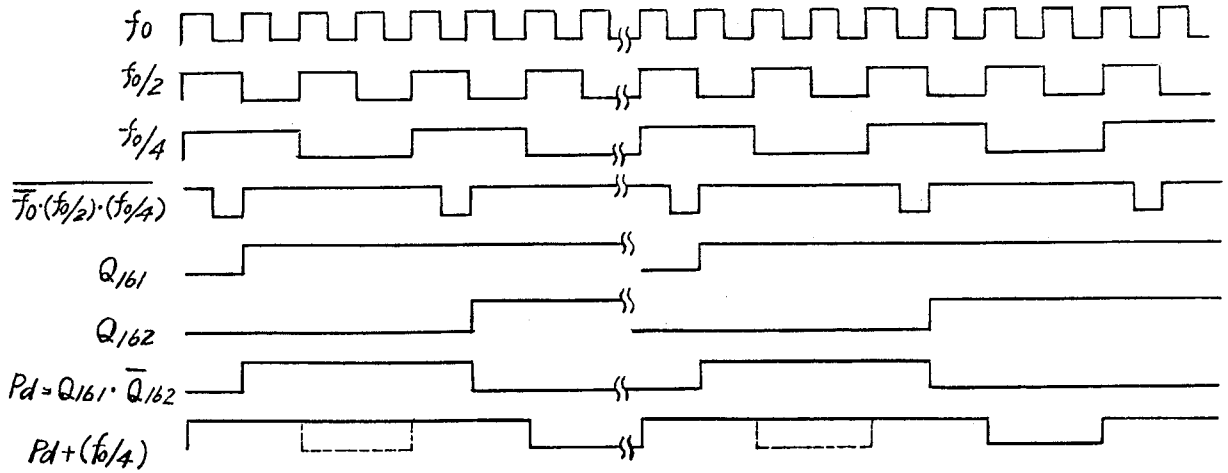
FIG. 5 is a time chart showing various signals occurring within the lose correction signal generator of FIG. 3.

The operation mode of the lose correction signal generator 16 will be described with reference to a time chart of FIG. 5.

The NAND gate $NAND_{16}$ functions to develop the logical product $\overline{f_o} \cdot (f_o/2) \cdot (f_o/4)$ by receiving the inverted signal $\overline{f_o}$ of the base signal $f_o$ generated from the oscillation circuit 1 and the outputs $f_o/2$ and $f_o/4$ of the first and second T-type flip-flops $FF_{21}$ and $FF_{22}$ of the frequency divider 2. When the D-type flip-flop $FF_{161}$ receives a signal of the logic value "1" at its D terminal, the Q terminal output $Q_{161}$ of the D-type flip-flop $FF_{161}$ takes the logical value "1" at the leading edge of the first output of the NAND gate $NAND_{16}$ and the Q terminal output $Q_{162}$ of the following D-type flip-flop $FF_{162}$ bears the logic value "1" at the following leading edge of the output of the NAND gate $NAND_{16}$.

The AND gate $AND_{16}$ develops the lose correction signal $P_d$ with the use of the logic product $Q_{161} \cdot \overline{Q_{162}}$ of the Q terminal output of the D-type flip-flop $FF_{161}$ and the $\overline{Q}$ terminal output of the D-type flip-flop $FF_{162}$.

The lose correction signal $P_d$ has a pulse width identical with one period of the output signal $f_o/4$ and is positioned to have the logic value "1" when the output signal $f_o/4$ assumes the logic value "0" between the two adjacent portions of the logic value "1" and, therefore, it will be clear from the time chart, one pulse of the output signal $f_o/4$ is eliminated by the signal $P_d + f_o/4$ from the OR gate $OR_1$. The correction reference signal $F_1$ is provided once every sixty seconds and, therefore, the one pulse of the output signal $f_o/4$ is removed every one minute. When the one pulse of the output signal $f_o/4$ is removed once every one minute, the timepiece is rendered slow by 4/32768 per one minute. Therefore, when the lose correction signal generator 16 receives one pulse every one minute, the pulse number of the output signal $f_o/4$ is reduced by 1440 ($=60 \times 60 \times 24 \times [1/60]$) in a day and, hence, the timepiece is rendered slow by 0.176 seconds ( $4/32768 \times 1440$) in a day. The timepiece becomes slow by 5.28 seconds ($=0.176 \times 30$) in thirty days.

When the detection circuit 12 detects the time information between 9 and 13, the second detection signal $C_2$ assumes the logic value "1". The correction reference signal $F_2$ is applied to the lose correction signal generator 16 and, therefore, the pulse number of the output signal $f_o/4$ is reduced by two every one minute. In this way, the timepiece becomes slow by 10.56 seconds in a month. In the same manner, when the detection circuit 12 detects the time information within renges 14 – 18, or 19 – 23, the timepiece is rendered slow by 15.84 seconds or 21.12 seconds in a month.

When the time information within ranges 24 – 26, 27 – 31, 32 – 36, 37 – 41, 42 – 46, 47 – 51, or 52 – 56 is detected by the detection circuit 12, the second detection signals $C_5$ through $C_{11}$ are developed, respectively. The gain correction value determination circuit 15 outputs the correction reference signals $F_7$, $F_6$, $F_5$, $F_4$, $F_3$, $F_2$ and $F_1$ as the signal $P_f'$ in response to the second detection signals $C_5$, $C_6$, $C_7$, $C_8$, $C_9$, $C_{10}$ and $C_{11}$.

Figure 6:
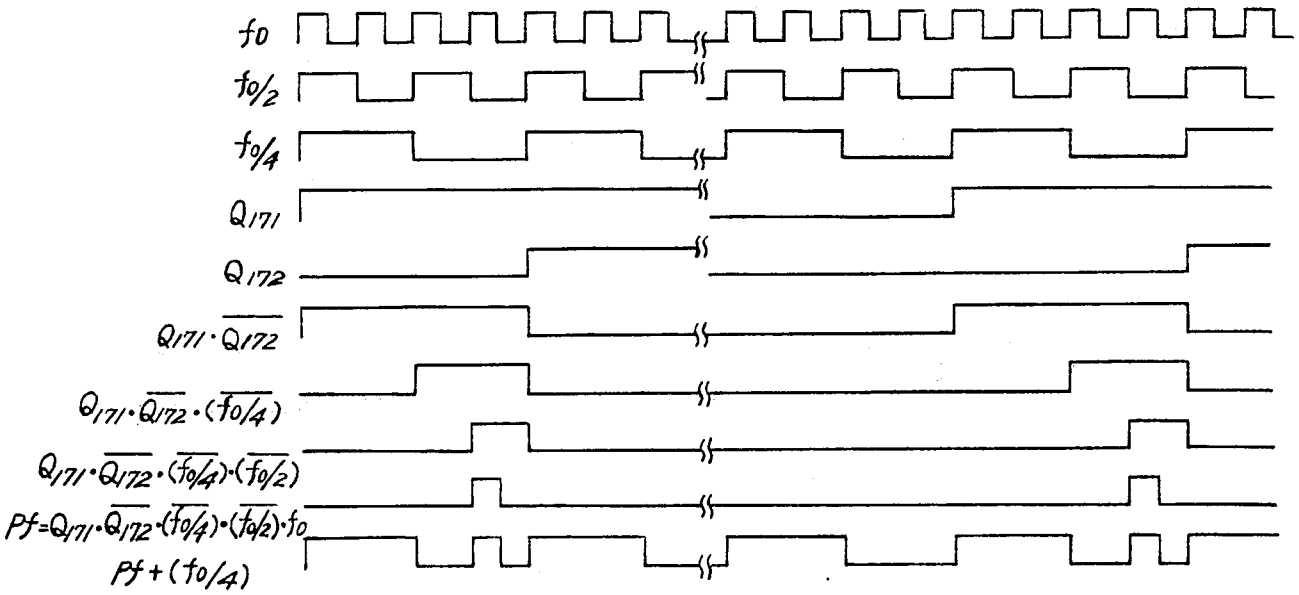
FIG. 6 is a time chart showing various signals occurring within the gain correction signal generator of FIG. 4.

The operation mode of the gain correction signal generator 17 will be described with reference to a time chart of FIG. 6.

When the D terminal of the D-type flip-flop $FF_{171}$ receives the signal of the logic value "1", the Q terminal outpu of the D-type flip-flop $FF_{171}$ assumes the logic value "1" upon occurrence of the first leading edge of the output signal $f_o/4$ and the Q terminal output of the following D-type flip-flop $FF_{172}$ takes the logic value "1" upon occurrence of the succeeding leading edge of the output signal $f_o/4$. The AND gate $AND_{171}$ provides the AND gate $AND_{172}$ with the logic product $Q_{171} \cdot \overline{Q_{172}}$. The AND gate $AND_{172}$ outputs the gain correction signal $P_f$ which is the logic product $Q_{171} \cdot \overline{Q_{172}} \cdot \overline{f_o/4} \cdot \overline{f_o/2} \cdot f_o$. The gain correction signal $P_f$ has a pulse width identical with a half period of the base signal $f_o$ and assumes the logic value "1" when the output signal $f_o/4$ bears the logic value "0".

The OR gate $OR_1$ develops a signal $f_o/4 + P_f$ and, therefore, the pulse number of the output signal $f_o/4$ is incremented one. The pulse number addition is carried out every time when the signal $P_f'$ assumes the logic value "1", the signal $P_f'$ being applied to the gain correction signal generator 17. Therefore, when the detection circuit 12 detects the time information within the range of 24 – 26, the correction reference signal $F_7$ is applied to the gain correction signal generator 17, thereby rendering the timepiece fast by 36.96 seconds a month. When the time information between 27 and 31 is detected and the correction reference signal $F_6$ is developed, the timepiece becomes fast by 31.68 seconds in a month. In a same manner, when the time information within the ranges 32 – 36, 37 – 41, 42 – 46, 47 – 51, or 52 – 56 is detected, the timepiece is controlled to become faster by 25.90 seconds, 21.12 seconds, 15.84 seconds, 10.56 seconds or 5.28 seconds in a month, respectively.

The above-mentioned correction can be tabulated as follows. In the following table, the symbol "−" means the "lose", whereas the symbol " + " represents the "gain". The delayed time is expressed in parenthesis.

TABLE OF CORRECTION OF DISPLACEMENT

| Second Information At The Zero Adjustment Operation (Seconds) | Correction Value (Seconds/Month) | Displacement After The Correction (Seconds/Month) |
|---|---|---|
| 0 ~ 3 | 0 | 0 ~ + 3 |
| 4 ~ 8 | − 5.23 | − 1.28 ~ + 2.72 |
| 9 ~ 13 | − 10.56 | − 1.56 ~ + 2.44 |
| 14 ~ 18 | − 15.84 | − 1.84 ~ + 2.16 |
| 19 ~ 23 | − 21.12 | − 2.12 ~ + 1.88 |
| 24 ~ 26 (36 ~ 34) | + 36.96 | − 2.96 ~ + 0.96 |
| 27 ~ 31 (33 ~ 29) | + 31.68 | − 2.68 ~ + 1.32 |
| 32 ~ 36 (28 ~ 24) | + 26.40 | − 2.40 ~ + 1.60 |
| 37 ~ 41 (23 ~ 19) | + 21.12 | − 2.12 ~ + 1.88 |
| 42 ~ 46 (18 ~ 14) | + 15.34 | − 1.84 ~ + 2.16 |
| 47 ~ 51 (13 ~ 9) | + 10.56 | − 1.56 ~ + 2.44 |
| 52 ~ 56 (8 ~ 4) | + 5.28 | − 1.28 ~ + 2.72 |
| 57 ~ 59 (3 ~ 1) | 0 | − 1 ~ + 3 |

It will be clear that the displacement can be reduced below three seconds per one month after the correction. The present system does not perform the frequency correction when the displacement is within the range below three seconds per one month.

The electronic timepiece employing a quartz oscillator of 32.768 kilohertz and C-MOS circuits has generally a greater tendency to lose than to gain. Therefore, the boundary area to add one to the minute information at the zero adjustment operation is selected at 24 seconds. The displacement in a month of the electronic timepiece mostly belongs within a range between gaining 20 seconds and losing 40 seconds.

When the zero adjustment operation is performed after a lapse of more than one month, there is a possibility that the timepiece has gained more than 24 seconds or has lost more than 36 seconds. When, for example, the timepiece has gained 50 seconds when the zero adjustment command is generated, the system erroneously detects that the timepiece has lost 10 seconds. Under these conditions, when the frequency correction is carried out, the timepiece will become faster. To avoid the above-mentioned erroneous correction, the duration counter 11 functions to inhibit the frequency correction when the zero adjustment command is generated after a lapse of more than one month. That is, the contents of the buffer memory 7 will not be changed when the output $d_{30}$ assumes the logic value "1".

In this way, only the zero adjustment operation is carried out when the zero adjustment command is generated after a lapse of more than one month. The frequency correction is not carried out when it is not desirable. There is a possibility that the zero adjustment operation is erroneously performed, that is, the increment one is erroneouly effected on the minute information when the timepiece has gained more than 24 seconds. But the minute information can be easily corrected through the use of the conventional time setting switches and, therefore, the zero adjustment operation is not controlled by the output $d_{30}$ of the duration counter 11.

Figure 7:
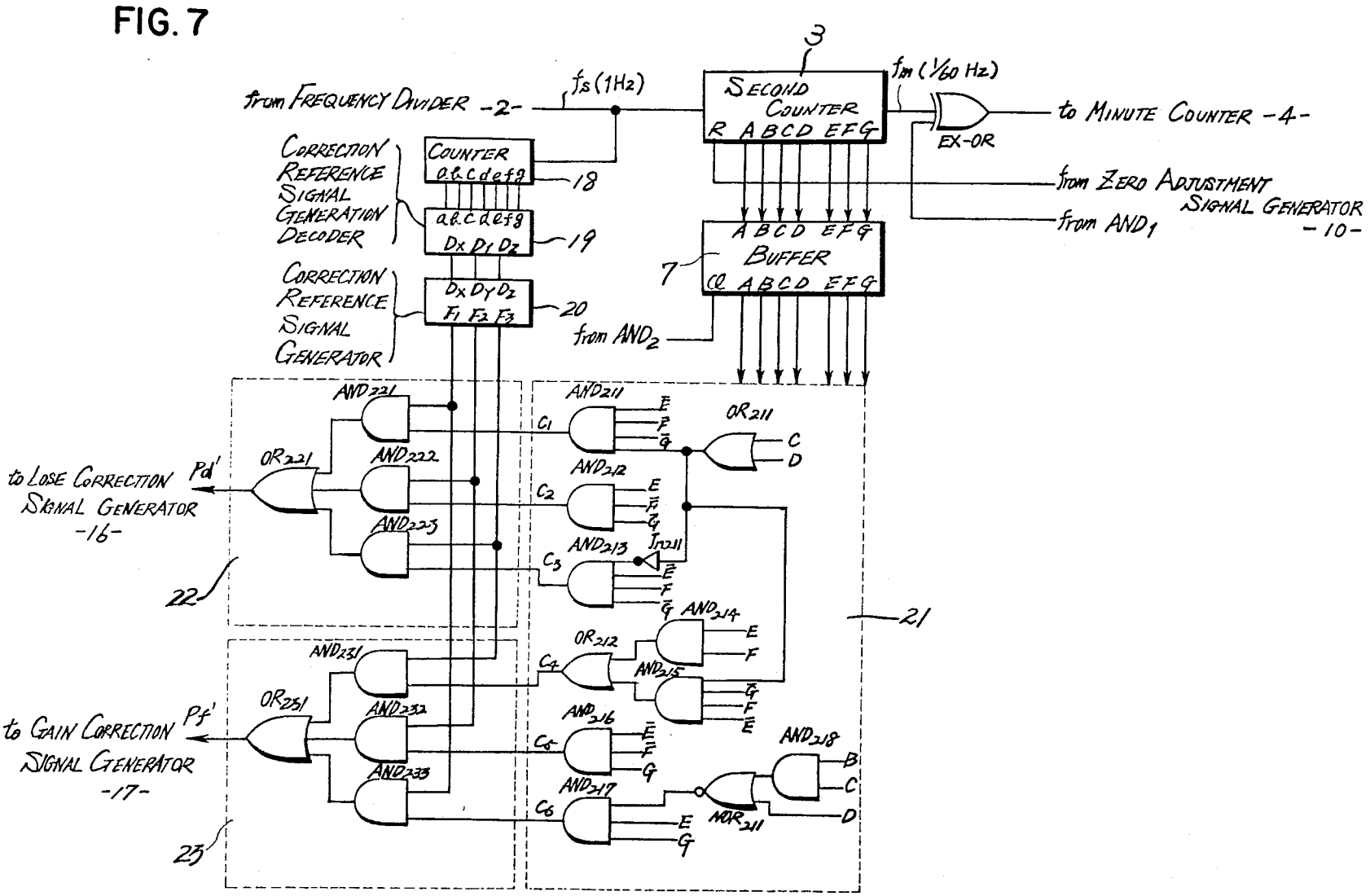
FIG. 7 is a block diagram of essential parts of another embodiment of the present invention.

FIG. 7 shows essential parts of another embodiment of the present invention which includes a counter 18 of radix 48, a correction reference signal generation decoder 19, a correction reference signal generator 20, a detection circuit 21, a lose correction value determination circuit 22 and a gain correction value determination circuit 23.

The detection circuit 21 comprises AND gates $AND_{211}$ through $AND_{218}$, OR gates $OR_{211}$ and $OR_{212}$, an NOR gate $NOR_{211}$, and an inverter $In_{211}$. The AND gate $AND_{211}$ and the OR gate $OR_{211}$, in combination, develop the logic product $\overline{E}.\overline{F}.\overline{G}$ (C + D) as a detection signal $C_1$, thereby detecting the sound information within a range 4 - 9 seconds. The AND gate $AND_{212}$ develops the logic product $E.\overline{F}.\overline{G}$ as a detection signal $C_2$, thereby detecting the second information within a range 10 - 19 seconds stored in the buffer memory 7. The AND gate $AND_{213}$, the inverter $In_{211}$ and the OR gate $OR_{211}$, in combination, develop the logic product $\overline{E} \cdot F \cdot \overline{G}\,(\overline{C + D})$ as a detection signal $C_3$, thereby detecting the second information within a range 20 - 23 seconds. The OR gate $OR_{212}$ and the AND gates $AND_{214}$, $AND_{215}$, in combination, develop the logic sum $\overline{E} \cdot F \cdot \overline{G}.\,(C + D) + E \cdot F$ as a detection signal $C_4$, thereby detecting the second information within a range 24 through 39 seconds stored in the buffer memory 7. The AND gate $AND_{216}$ develops the logic product $\overline{E} \cdot \overline{F} \cdot G$ as a detection signal $C_5$, thereby detecting the second information within a range of 40 through 49 seconds. The AND gates $AND_{217}$, $AND_{218}$ and the NOR gate $NOR_{211}$, in combination, develop the logic product $E \cdot G \cdot (B \cdot C + D)$ as a detection signal $C_6$, thereby detecting the second information within a range 50 through 55 seconds stored in the buffer memory 7.

The detection signals $C_1$ through $C_3$ are applied to the lose correction value determination circuit 22, whereas the detection signals $C_4$ through $C_6$ are applied to the gain correction value determination circuit 23.

The counter 18 of radix 48 receives the reference signal $f_s$ of one hertz to develop correction reference signals $F_1$, $F_2$ and $F_3$. The correction reference signal generation decoder 19 develops signals $D_X$, $D_Y$ and $D_Z$ when the contents of the counter 18 is "X", "Y" and "Z", respectively. The correction reference signals $F_1$, $F_2$ and $F_3$, which are logic sums $D_X$, $D_X + D_Y$, $D_X + D_Y + D_Z$, respectively. Therefore, the correction reference signals $F_1$, $F_2$ and $F_3$ are signals of 1/48 hertz, 1/24 hertz and 1/12 hertz, respectively.

The lose correction value determination circuit 22 comprises AND gates $AND_{211}$, $AND_{222}$ and $AND_{223}$, and an OR gate $OR_{221}$. The AND gate $AND_{221}$ receives the correction reference signal $F_1$ and the detection signal $C_1$. The AND gate $AND_{222}$ receives the correction reference signal $F_2$ and the detection signal $C_2$, and the AND gate $AND_{223}$ receives the correction reference signal $F_3$ and the detection signal $C_3$. Respective output signals of the AND gates $AND_{221}$ through $AND_{223}$ are applied to the OR gate $OR_{221}$, which develops an output $P_d'$ to be applied to the lose correction signal generator 16 of FIG. 1.

The gain correction value determination circuit 23 comprises AND gates $AND_{231}$ through $AND_{233}$ and an OR gate $OR_{231}$. The AND gates $AND_{231}$, $AND_{232}$ and $AND_{233}$ receive the correction reference signals $F_1$, $F_2$, $F_3$ and the detection signals $C_4$, $C_5$, $C_6$, respectively, thereby developing an output $P_f'$ to be applied to the gain correction signal generator 17 of FIG. 1 through the OR gate $OR_{231}$.

In this way, the timepiece is rendered slow by 6.6 seconds in a month when the detection signal $C_1$ assumes the logic value "1". The timepiece is rendered slow by 13.2 seconds or 26.4 seconds in a month when the detection signals $C_2$ or $C_3$ assumes the logic value "1". Contrarily, the timepiece is rendered fast by 26.4 seconds, 13.2 seconds or 6.6 seconds in a month when the detection signals $C_4$, $C_5$ or $C_6$ bears the logic value "1".

The above-mentioned correction can be tabulated as follows:

TABLE OF CORRECTION OF DISPLACEMENT

| Second Information At The Zero Adjustment Operation (Seconds) | Correction Value (Seconds/Month) | Displacement After The Correction (Seconds/Month) |
|---|---|---|
| 1 ~ 3 | 0 | + 1 ~ + 3 |
| 4 ~ 9 | − 6.6 | − 2.6 ~ + 2.4 |
| 10 ~ 19 | − 13.2 | − 3.2 ~ + 5.8 |
| 20 ~ 23 | − 26.4 | − 6.4 ~ − 3.5 |
| 24 ~ 39 (36 ~ 21) | + 26.4 | − 9.6 ~ + 5.4 |
| 40 ~ 49 (20 ~ 11) | + 13.2 | − 6.8 ~ + 2.2 |
| 50 ~ 55 (10 ~ 5) | + 6.6 | − 3.4 ~ + 1.6 |
| 56 ~ 0 (4 ~ 0) | 0 | 0 ~ − 4 |

The invention being thus described, it will be obvious that the same may be varied in many ways. Such variations are not to be regarded as a departure from the spirit and scope of the invention, and all such modifications are intended to be included within the scope of the following claims.

What is claimed is:

1. In an electronic timepiece which comprises a base signal generator, a frequency divider for developing a reference signal, a time information calculation circuit responding to the reference signal, a display system for displaying the time information, a zero adjustment switch and a zero adjustment control circuit associated with the zero adjustment switch, the improvement comprising:

a. a detection circuit for developing detection signals in accordance with second information in the time information calculation circuit when the zero adjustment switch is closed; and b. a correction signal generator for correcting the frequency of the reference signal in response to the detection signals derived from the detection circuit.

2. The electronic timepiece of claim 1, wherein the frequency divider comprises a chain of T-type flip-flops and the correction signal from the correction signal generator is applied to a third T-type flip-flop in the frequency divider through an OR gate, the other input terminal of the OR gate receiving the output of a second T-type flip-flop in the frequency divider.

3. The electronic timepiece of claim 1, which further comprises a buffer momory for storing the second information in the time information calculation circuit at the time when the zero adjustment switch is closed, wherein the correction signal generator is connected to receive output signals of the buffer memory.

4. The electronic timepiece of claim 1, wherein the correction signal generator develops a correction signal to increase the frequency of the reference signal when the detection circuit detects the second information greater than a predetermined value, and develops a correction signal to decrease the frequency of the reference signal when the detection circuit detects the second information below the predetermined value.

5. The electronic timepiece of claim 4, wherein the predetermined value is twenty-four seconds.

6. The electronic timepiece of claim 1, which further comprises a duration counter for detecting a time period initiating upon closing of the zero adjustment switch and terminating upon the following closing of the zero adjustment switch; and an inhibiting means for inhibiting the frequency correction when the duration counter detects over a predetermined time period.

7. The electronic timepiece of claim 6, wherein the duration counter receives a day signal in the frequency divider and the predetermined time period is thirty days.

8. In an electronic timepiece which comprises a base signal generator; a frequency divider for developing a reference signal of one hertz; a time information calculation circuit including a second information counter, a minute information counter, an hour information counter and a day information counter; a display system for displaying the time information; a zero adjustment switch; and a zero adjustment control circuit associated with the zero adjustment switch, the improvement comprising:

a. a duration counter which receives output signals of the hour information counter to develop an inhibit signal when the duration counter counts more than a predetermined time period;

b. a buffer memory for reading and for storing therein time information from the second information counter;

c. a control means for controlling the reading operation of the buffer memory in such a manner that the contents of the buffer memory is changed only when the zero adjustment switch is closed at a time when the inhibit signal is not generated;

d. a reset means for resetting the contents of the duration counter when the zero adjustment switch is closed;

e. a detection circuit for developing detection signals in accordance with the time information stored in the buffer memory; and f. a correction signal generator for correcting the frequency of the reference signal in response to the detection signals derived from the detection circuit.

* * * * *